US006998798B1

(12) United States Patent
Guan et al.

(10) Patent No.: US 6,998,798 B1
(45) Date of Patent: Feb. 14, 2006

(54) DIGITALLY CONTROLLED VERTICAL S LINEARITY CORRECTION WITH CONSTANT AMPLITUDE WITHOUT USING AN AGC

(75) Inventors: Charles Guan, San Francisco, CA (US); Peyman Hojabri, San Jose, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 21 days.

(21) Appl. No.: 10/915,135

(22) Filed: Aug. 10, 2004

(51) Int. Cl.
*G09G 1/04* (2006.01)

(52) U.S. Cl. ..... 315/370; 315/364

(58) Field of Classification Search ..... 315/370, 315/364, 365–366, 368–18, 367
See application file for complete search history.

(56) References Cited

U.S. PATENT DOCUMENTS 3,848,155 A * 11/1974 Titus et al. ..... 315/370
4,380,776 A * 4/1983 Smith et al. ..... 348/107
4,874,992 A * 10/1989 Benson et al. ..... 315/387
4,876,488 A * 10/1989 Gentile ..... 315/378
4,945,292 A * 7/1990 Ackerson et al. ..... 315/387
4,980,613 A * 12/1990 Miyama et al. ..... 315/366
6,411,098 B1 * 6/2002 Laletin ..... 324/436
6,577,083 B1 * 6/2003 Guan ..... 315/370

OTHER PUBLICATIONS

STMicroelectronics. TDAS9112 Low-Cost I²C Controlled Deflection Processor for Multisync Monitor. Aug. 2003. 26pp.

* cited by examiner

*Primary Examiner*—Trinh Vo Dinh
*Assistant Examiner*—Hung Tran Vy
(74) *Attorney, Agent, or Firm*—Darby & Darby P.C.; John W. Branch

(57) ABSTRACT

A digitally-controlled vertical S linearity correction with a constant amplitude without using an AGC. To preserve line spacing between horizontal lines toward a top and bottom of a screen a third order correction voltage $V_{cube}$ is applied to a sweep voltage $V_{osc}$. A constant current decoder determines an amount of appropriate correction current, which is employed to generate a sweep voltage with modified amplitude due to S correction and one without the modified amplitude. The sweep voltage with constant amplitude is employed to generate $V_{cube}$. $V_{cube}$ is then applied to the sweep voltage along with a compensated amplitude component of the sweep voltage, such that a reduction in the amplitude caused by the S correction is compensated in the output voltage $V_{out}$. The compensation of the output voltage amplitude prevents a size reduction of the displayed picture on the screen without employing an iterative auto-align process.

15 Claims, 6 Drawing Sheets

DIGITALLY CONTROLLED VERTICAL S LINEARITY CORRECTION WITH CONSTANT AMPLITUDE WITHOUT USING AN AGC

FIELD OF THE INVENTION

The present invention relates to cathode ray tube (CRT) controls, and in particular, to a method and circuit for performing a digitally controlled vertical S linearity correction with a constant amplitude without using automatic gain control (AGC).

BACKGROUND

Cathode Ray Tube's (CRT's) are commonly used in many industrial and consumer electronic devices such as EKG-monitors, oscilloscopes, computer monitors, TV's, and the like. CRT based monitors typically include a CRT and control circuitry. The CRT generally comprises a glass tube with a "bottle neck" portion and a screen, an electron beam gun, and filter devices that are arranged to mask and guide the electron beam.

The screen is internally coated with a photo-emitting material (commonly, a phosphor-based chemical), which is activated by the electron beam. When electrons impinge on the inside of the screen, the energetic electrons collide with photo-emitting material, which generates pixels on the display. Because the screen is not shaped as a perfect sphere and the displayed information is generally rectangularly shaped, an intensity of the electron beam is controlled by various circuits for different regions of the display.

Control circuitry includes horizontal and vertical control circuits among other sub-circuits. While the horizontal control circuit manages an adjustment and a correction of horizontal deflection frequency, the vertical control circuit's main goal is to drive vertical deflection output stage. The vertical control circuit generally provides a sawtooth waveform for geometric linearity corrections of the electron beam.

Thus, it is with respect to these considerations and others that the present invention has been made.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Detailed Description of the Invention, which is to be read in association with the accompanying drawings, wherein.

DETAILED DESCRIPTION

The present invention now will be described more fully hereinafter with reference to the accompanying drawings, which form a part hereof, and which show, by way of illustration, specific exemplary embodiments by which the invention may be practiced. This invention may, however, be embodied in many different forms and should not be construed as limited to the embodiments set forth herein; rather, these embodiments are provided so that this disclosure will be thorough and complete, and will fully convey the scope of the invention to those skilled in the art. Among other things, the present invention may be embodied as methods or devices. Accordingly, the present invention may take the form of an entirely hardware embodiment or an embodiment combining software and hardware aspects. The following detailed description is, therefore, not to be taken in a limiting sense.

Briefly stated, the present invention is related to providing digitally-controlled vertical S linearity correction with a constant amplitude without using an AGC. In a typical CRT-based monitor, an electron beam is swept by a horizontal and a vertical sweep voltage. The sweep voltage commonly has a substantially sawtooth shape. Because a screen of a CRT tube is not substantially spherical and a picture that is displayed has a rectangular shape, line spacing toward the edges of the screen may need to be modified to preserve uniformity of the displayed picture.

To preserve the uniformity of the picture, an S linearity correction (also termed S correction) may be applied to the sweep voltage, $V_{osc}$. The S correction is essentially a third order (cubed) voltage (the term S is derived from the S-like shape of a third order waveform) that is added onto the sawtooth-like ramping voltage. The S correction provides for equal line spacing of the horizontal lines on the screen toward the top and bottom edges. At the same time the line spacing at the top and bottom of the screen is also made substantially the same as in the middle of the screen.

Generally, the addition of the third order voltage causes a reduction on the amplitude of the sawtooth-like sweep voltage, if no other correction is applied. This may result in a reduction of the displayed picture on the screen. According to one aspect of the present invention, a second voltage component that is multiplied with a second coefficient is added to the sweep voltage enabling a compensation of the amplitude reduction without employing an iterative adjustment process.

Figure 1:
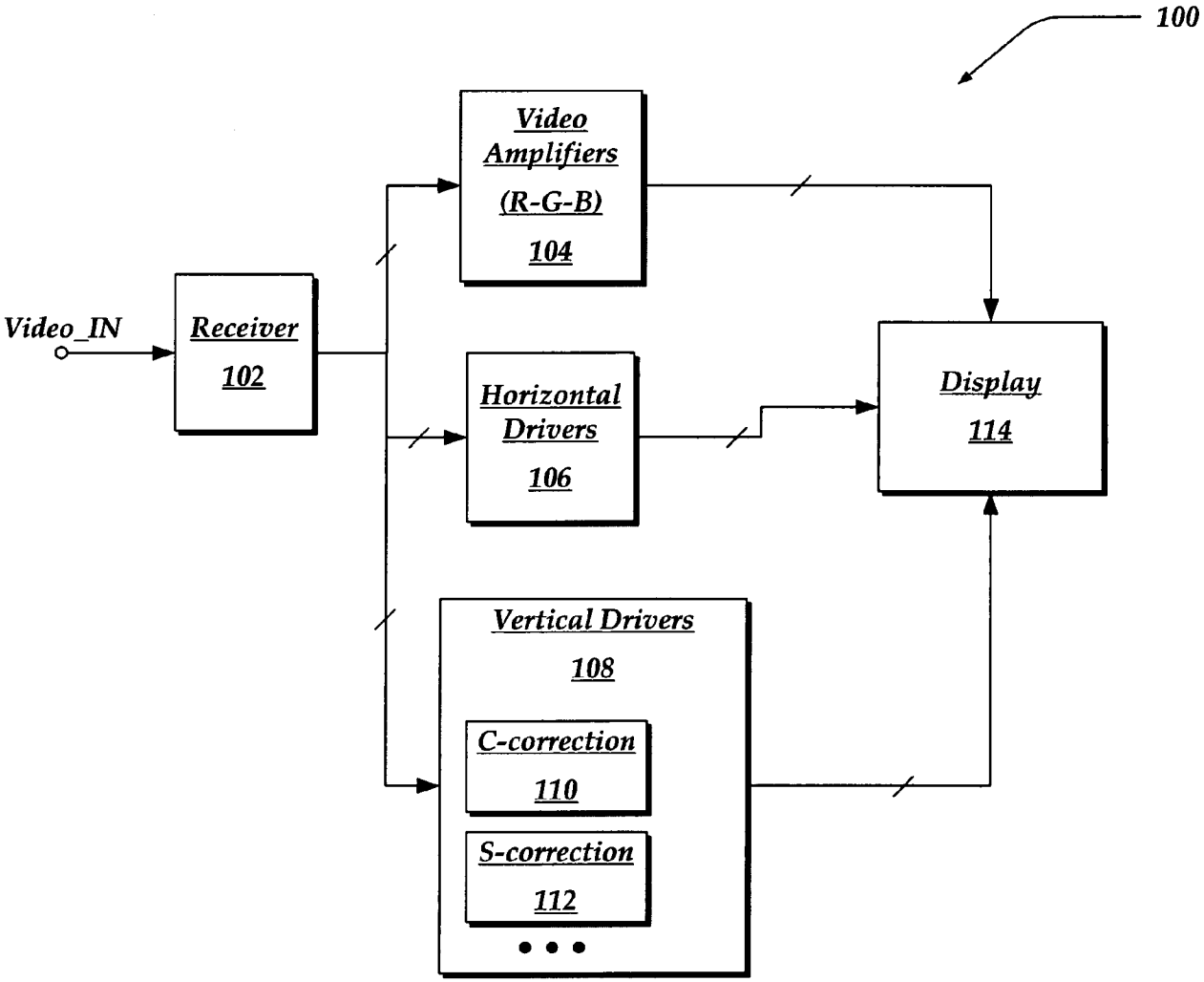
FIG. 1 is a block diagram illustrating a CRT-based monitor and its control circuitry.

FIG. 1 is a block diagram illustrating CRT-based monitor 100 and its control circuitry. CRT-based monitor 100 includes receiver 102, video amplifiers 104, horizontal drivers 106, vertical drivers 108, and display 114. Vertical drivers 108 may include among other circuits, C linearity correction circuit 110, and S linearity correction circuit 112. CRT-based monitor 100 may include additional components known to those skilled in the art.

CRT-based monitor 100 is arranged to receive an external signal Video_IN at receiver 102 and display a picture on display 114 based on Video_IN. Receiver 102 is arranged to process Video_IN and provide control circuitry, such as video amplifiers 104, horizontal drivers 106, vertical drivers 108, and the like, with an input signal. Typically, display 114 includes an electron beam generator, a screen, and filtering and control devices that may be driven by outputs of video amplifiers 104, horizontal drivers 106, vertical drivers 108, and the like. An internal surface of the screen may be coated with photo-emitting material that is activated by an electron beam from the electron beam generator.

In a color CRT-based monitor, the electron beam or multiple electron beams may be directed to different color emitting pixels on the screen such as red-green-blue. Such a monitor may include multiple video amplifiers 104 for each basic color (red, green, and blue).

The electron beam is commonly swept across the screen horizontally and vertically to form the desired picture on the screen. Horizontal drivers 106 and vertical drivers 108 are arranged to provide voltages for sweeping the electron beam across the screen. Because a shape of the screen is typically not an ideal sphere and a displayed picture is typically substantially rectangular, non-linearities may occur in form of non-linear vertical line spacing, and the like.

To compensate for those non-linearities, correction factors may be applied to horizontal and vertical sweep voltages provided by horizontal drivers 106 and vertical drivers 108. In one embodiment, vertical drivers 108 may include a C linearity correction circuit 110 and a S linearity correction circuit 112. These circuits may correct the sweep voltages such that line spacing toward a top and bottom edge of the screen is maintained substantially the same as in a center of the screen.

As described above, the term S linearity correction is derived from an S-like shape of a third order voltage $V_{cube}$, which is added to a sawtooth-shaped sweep voltage $V_{osc}$ for correction. $V_{osc}$ is arranged to control a sweep of the electron beam across the screen. An amount of S correction that is appropriate may vary from one CRT to another, and the addition of $V_{cube}$ may reduce an amplitude of $V_{osc}$. An iterative auto-align process utilizing a camera feedback and an AGC circuit may be employed to provide S correction, while maintaining a picture size on the screen substantially the same as before the S correction. Digital control of the S correction without the iterative auto-align process, as provided by one embodiment of the present invention, may provide for ease and lower cost of manufacturing.

The cubed voltage for S correction may be derived from the sweep voltage itself such that a corrected output voltage may be expressed as:

$$V_{out}=V_{osc}+b*V_{osc}^3 \quad (1),$$

where "b" is a negative correction coefficient. Accordingly, $V_{cube}=V_{osc}^3$. In one embodiment, a value of $V_{osc}$ at the center of a sawtooth-shaped waveform may be employed to derive the cubed voltage. The addition of $b*V_{cube}$ (with "b" being the negative coefficient) to $V_{osc}$ may reduce the amplitude of output voltage $V_{out}$ resulting in a reduction of the size of the displayed picture on the screen.

According to one embodiment of the invention, the reduction effect of S linearity correction may be compensated employing a non-iterative approach, eliminating an AGC. Vertical S linearity correction circuit 212 provides an amplitude compensation factor based on multiplying $V_{osc}$ with a second correction factor "a", such that the amplitude of $V_{out}$ remains substantially constant. Accordingly, a value of "a" may depend on a value of "b", and output voltage $V_{out}$ as generated by vertical S linearity correction circuit 212 may be expressed as:

$$V_{out}=a*V_{osc}+b*V_{cube} \quad (2).$$

S linearity correction circuit 112 is discussed in more detail below in conjunction with FIGURE's 2 and 3.

FIG. 1 shows a particular arrangement of inputs and outputs of the various components. Other arrangements of the components may be implemented without departing from the scope and spirit of the present invention.

Figure 2:
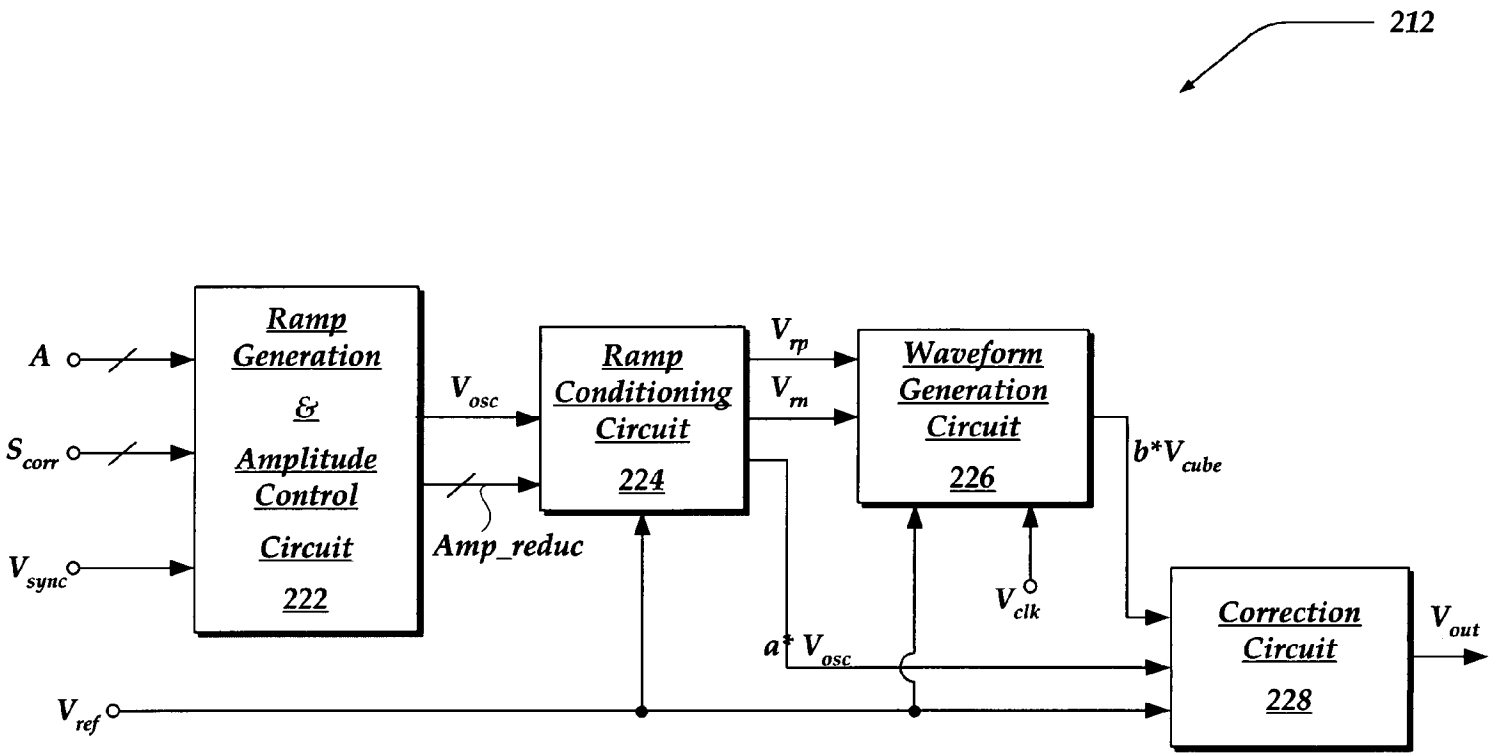
FIG. 2 is a block diagram illustrating one embodiment of a vertical S linearity correction circuit.

FIG. 2 is a block diagram illustrating an embodiment of vertical S linearity correction circuit 212. Vertical S linearity correction circuit 212 may be implemented in a vertical control section of a CRT control circuitry such as vertical drivers 108 of FIG. 1. Vertical S linearity correction circuit 212 is arranged to provide a corrected output voltage $V_{out}$ such that line spacing between horizontal lines toward a top and bottom edge of a screen is substantially the same as line spacing in the middle of the screen. Vertical S linearity correction circuit 212 includes ramp generation and amplitude control circuit 222, ramp conditioning circuit 224, waveform generation circuit 226, and correction circuit 228.

As shown in FIG. 2, ramp generation and amplitude control circuit 222 is arranged to receive a first plurality of digital signals $S_{corr}$ indicating an amount of appropriate S correction and a second plurality of digital signals A indicating an amount of sweep voltage amplitude, as well as a synchronization voltage $V_{synch}$. $S_{corr}$ and A may be provided from an internal or an external source based on a camera detection, a measurement, an operator input, and the like. Ramp generation and amplitude control circuit 222 is further arranged to generate a sawtooth-shaped voltage $V_{osc}$ for controlling a sweep of an electron beam across a screen, and to provide $V_{osc}$ to ramp conditioning circuit 224. An amplitude of $V_{osc}$ is determined based, in part, on $S_{corr}$ and A. However, as explained below, $S_{corr}$-independent $V_{osc}$ may be employed for generating S correction voltage $V_{cube}$ at ramp conditioning circuit 224. To enable ramp conditioning circuit 224 to generate $S_{corr}$-independent sweep voltage $V_{rp}$ ramp generation and amplitude control circuit 222 is also arranged to provide an amplitude reduction signal Amp_reduc to ramp conditioning circuit 224. $V_{synch}$ provides timing control for ramp generation and amplitude control circuit 222.

Ramp conditioning circuit 224 is arranged to receive $V_{osc}$ and to provide $a*V_{osc}$, which is employed to compensate for an amplitude reduction of $V_{out}$ due to the addition of $b*V_{cube}$ for S correction. Ramp conditioning circuit 224 is further arranged to provide $V_{rp}$, which is an $S_{corr}$-independent version of $V_{osc}$. The amplitude modulation effect of $S_{corr}$ on $V_{osc}$ is removed at ramp conditioning circuit 224 employing Amp_reduc provided by ramp generation and amplitude control circuit 222. In one embodiment, the modification of $V_{osc}$ in ramp conditioning circuit 224 provides the second correction factor "a" as described in conjunction with equations [1] and [2] above. VP, which is generated by applying Amp_reduc to $V_{osc}$ to remove the amplitude modification by $S_{corr}$, is employed by waveform generation circuit 226 to generate $b*V_{cube}$.

Figure 4:
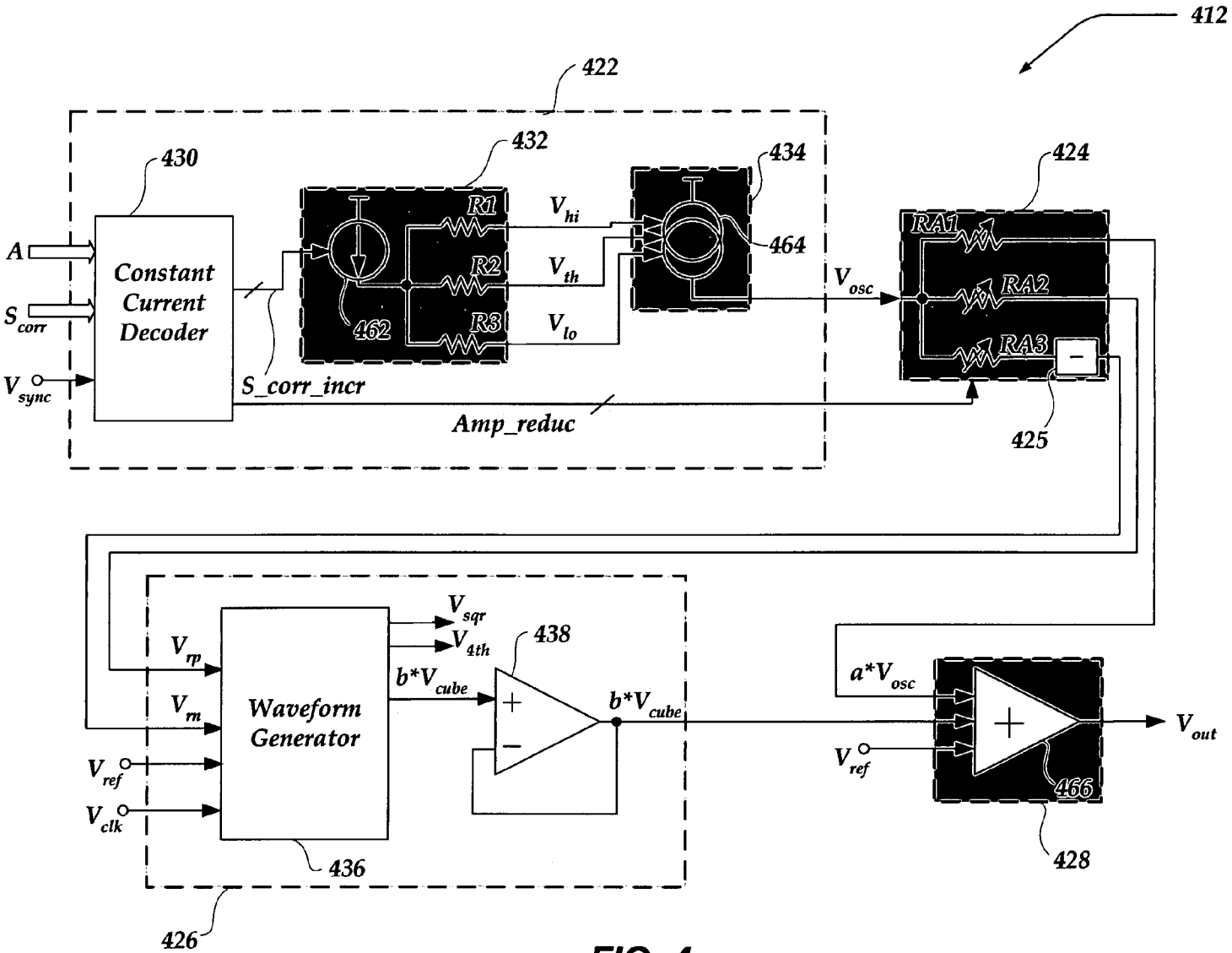
FIG. 4 schematically illustrates one embodiment of the vertical S linearity correction circuit of FIG. 3.

Waveform generation circuit 226 is arranged to receive $V_{rp}$, reference voltage $V_{ref}$, and clock voltage $V_{clk}$, and to provide third order S correction voltage $V_{cube}$ to correction circuit 228. In one embodiment, $V_{cube}$ may be generated based on a center value of $V_{rp}$ as shown in FIG. 4, and waveform generation circuit 226 may also be arranged to provide the first correction coefficient "b" such that $b*V_{cube}$ is provided to correction circuit 228. In another embodiment, waveform generation circuit 226 may provide $V_{cube}$ to correction circuit 228, which may provide the first coefficient "b" such that $V_{out}=a*V_{osc}+b*V_{cube}$.

In a further embodiment, waveform generation circuit 226 may also provide a second order and a fourth order voltage to be employed by a C linearity correction circuit and a top-and-bottom corner correction circuit that may be a part of a vertical driver circuit of a CRT-based monitor. For generating second and fourth order voltages, waveform generation circuit 226 may be arranged to receive an inverted version of $V_{rp}$, $V_{rn}$ from ramp conditioning circuit 224.

Correction circuit 228 is arranged to receive $b*V_{cube}$, $a*V_{osc}$, and $V_{ref}$, and to provide in response to the received voltages an S linearity corrected and amplitude compensated output voltage $V_{out}=a*V_{osc}+b*V_{cube}$. In one embodiment, correction circuit 228 may be arranged to receive $V_{cube}$ from waveform generation circuit 226 and provide multiplier "b" for $V_{cube}$ before performing the addition function between $V_{osc}$ and $V_{cube}$. $V_{out}$, is employed to control a vertical position of an electron beam in the CRT-based monitor. Voltage $b*V_{cube}$ enables substantially equal line spacing between the horizontal lines at the top and bottom of the screen and the middle of the screen. Voltage $a*V_{osc}$ enables maintaining a size of the displayed picture on the screen without employing an iterative auto-align process that may involve an AGC circuit.

FIG. 2 shows a particular arrangement of inputs and outputs of the various components. In one embodiment, all of the components of vertical S linearity correction circuit 212 may be included in the same chip. Alternatively, one or more of the components may be off-chip.

Figure 3:
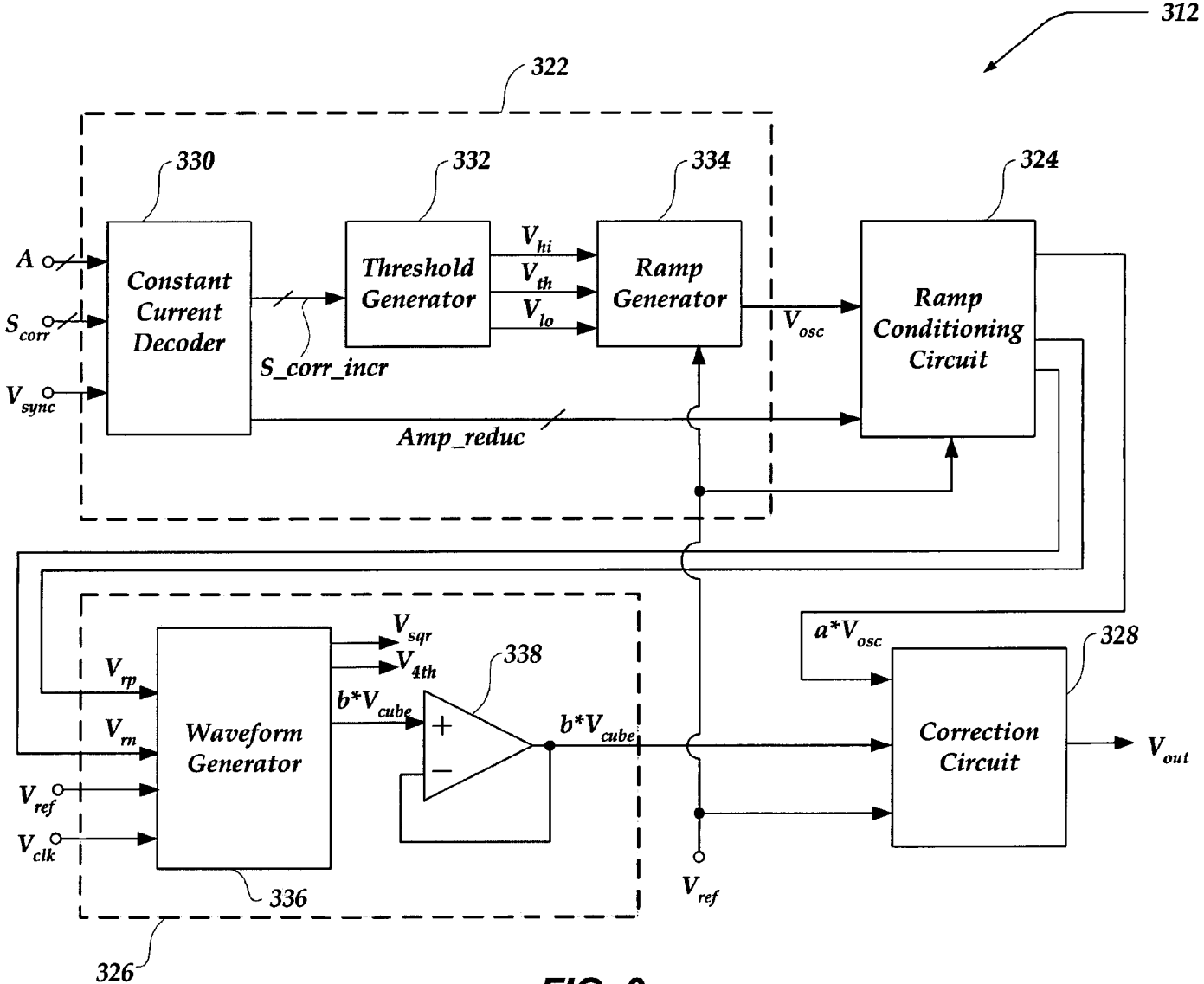
FIG. 3 illustrates a block diagram of one embodiment of the vertical S linearity correction circuit of FIG. 2 in more detail.

FIG. 3 illustrates a block diagram of an embodiment of vertical S linearity correction circuit 312. Vertical S linearity correction circuit 312 includes ramp generation and amplitude control circuit 322, ramp conditioning circuit 324, waveform generation circuit 326, and correction circuit 328. Ramp generation and amplitude control circuit 322 includes constant current decoder 330, threshold generator 332, and ramp generator 334. Waveform generation circuit 326 includes waveform generator 336 and operational amplifier 338.

Constant current decoder 330 is arranged to receive the first plurality of digital signals $S_{corr}$ indicating an amount of appropriate S correction and the second plurality of digital signals A indicating an amount of sweep voltage amplitude for $V_{out}$. $S_{corr}$ and A may provide the desired amounts of S correction and sweep voltage amplitude based on a camera feedback, a measurement, a predetermined monitor characteristic, and the like. Constant current decoder 330 is essentially configured to determine control signals for subsequent circuitry such that $a*V_{osc}$ and $b*V_{cube}$ are provided to correction circuit 328 for combination.

Accordingly, constant current decoder 330 provides S_corr_incr to threshold generator 332 based, in part, on S_corr and A. Threshold generator 332 is arranged to generate high and low limit voltages and a threshold voltage $V_{hi}$, $V_{lo}$, and $V_{th}$ based on S_corr_incr. $V_{hi}$, $V_{lo}$, and $V_{th}$ are subsequently employed to generate sweep voltage $V_{osc}$, which is indirectly based on S_corr_incr.

In one embodiment, S_corr_incr may be a plurality of currents that is employed to control a current-controlled current source in threshold generator 332, which generates $V_{hi}$, $V_{lo}$, and $V_{th}$ employing a resistive ladder. In another embodiment, S_corr_incr may be a plurality of digital signals that control a voltage-controlled current or voltage source in threshold generator 332.

$V_{synch}$ may be employed for timing control of constant current decoder 330. In another embodiment, constant current decoder 330 may provide further timing voltages to subsequent circuits based on $V_{synch}$.

Because S correction voltage $V_{cube}$ is determined based on the sweep voltage $V_{osc}$, and the amplitude of $V_{osc}$ is determined based on S_corr_incr, an effect of S_corr_incr on the amplitude of $V_{out}$ may be complicated. To enable a non-iterative compensation of amplitude reduction effect on $V_{out}$, constant current decoder 330 may provide Amp_reduc to ramp conditioning circuit 324, which may employ Amp_reduc to provide $V_{rp}$, an $S_{corr}$-independent version of $V_{osc}$. Accordingly, S correction voltage $b*V_{cube}$ may be combined with compensation voltage $a*V_{osc}$ providing a simple and linear approach for generating an S-corrected output voltage $V_{out}$.

Ramp generator 324 employs $V_{hi}$, $V_{lo}$, and $V_{th}$ to provide $V_{osc}$. $V_{hi}$ and $V_{lo}$ provide and upper and a lower limit for the sawtooth-shaped $V_{osc}$. $V_{th}$ is employed to determine a DC component of $V_{osc}$ for use in other correction circuitry.

Ramp conditioning circuit 324 may be implemented as a digitally-controlled attenuator, and provide $a*V_{osc}$ based on Amp_reduc to correction circuit 328.

Threshold generator 332 is arranged to provide a high limit voltage $V_{hi}$, a low limit voltage $V_{lo}$, and a threshold voltage $V_{th}$ in response to S_corr_incr. In one embodiment, threshold generator 332 may be implemented as a current-controlled current source and a resistor ladder. By providing $V_{lo}$, $V_{hi}$, and $V_{th}$, threshold generator 332 determines an amplitude of $V_{osc}$ based on input from constant current decoder 330.

Ramp generator 334 may be implemented as a voltage-controlled voltage source in one embodiment, and is arranged to provide sawtooth-shaped voltage $V_{osc}$ to ramp conditioning circuit 324 in response to $V_{hi}$, $V_{lo}$, $V_{th}$, and reference voltage $V_{ref}$.

Ramp conditioning circuit 324 is arranged to receive $V_{osc}$, $V_{ref}$, and amplitude correction signal Amp_reduc, and to provide amplitude-corrected sweep voltage $a*V_{osc}$ and two additional sweep voltages $V_{rp}$ and $V_{rn}$, which do not include amplitude correction. $V_{rn}$ is an inverted version of $V_{rp}$ and may be employed in generating second and fourth order voltages for other types of linearity corrections. In one embodiment, ramp conditioning circuit 324 may be implemented as a digitally-controlled resistive attenuator. Amplitude-corrected sweep voltage $a*V_{osc}$ represents $a*V_{osc}$ in the S-correction equation [2] discussed above and may be provided to correction circuit 328 for combination with $b*V_{cube}$.

Waveform generator 336 is arranged to provide, in response to $V_{rp}$ and $V_{rn}$ from ramp conditioning circuit 324, third order correction voltage $V_{cube}$. As discussed above, $V_{cube}$ may be obtained from a center value of $V_{rp}$. The correction coefficient "b" may be implemented as a multiplying factor of $V_{cube}$ in wave generation circuit 326 or in correction circuit 328.

In one embodiment, third order voltage $V_{cube}$ may be provided to operational amplifier 338, which is arranged to operate as a follower and provide $V_{cube}$ to correction circuit 328. Since an amplitude of $V_{rp}$ is determined by ramp conditioning circuit 324, an amplitude Of $V_{cube}$ may be based, in part, on a setting of ramp conditioning circuit 324.

Correction circuit 328 is arranged to operate substantially similarly to like-numbered correction circuit 228 of FIG. 2.

FIG. 4 schematically illustrates one embodiment of vertical S linearity correction circuit 412. Vertical S linearity correction circuit 412 includes substantially the same subcircuits as vertical S linearity correction circuit 312 of FIG. 3, and operates substantially similarly.

Ramp generation and amplitude control circuit 422 includes constant current decoder 430, threshold generator 432, and ramp generator 434. Constant current decoder 430 is arranged to receive first digital input signal $S_{corr}$ and second digital input signal A, and determine a control signal S_corr_incr for generating $V_{lo}$, $V_{hi}$, and $V_{th}$ at the next subcircuit, threshold generator 432. Constant current decoder 430 is further arranged to provide Amp_reduc to ramp conditioning circuit 424 for providing an $S_{corr}$-independent sweep voltage $V_{rp}$.

Figure 5:
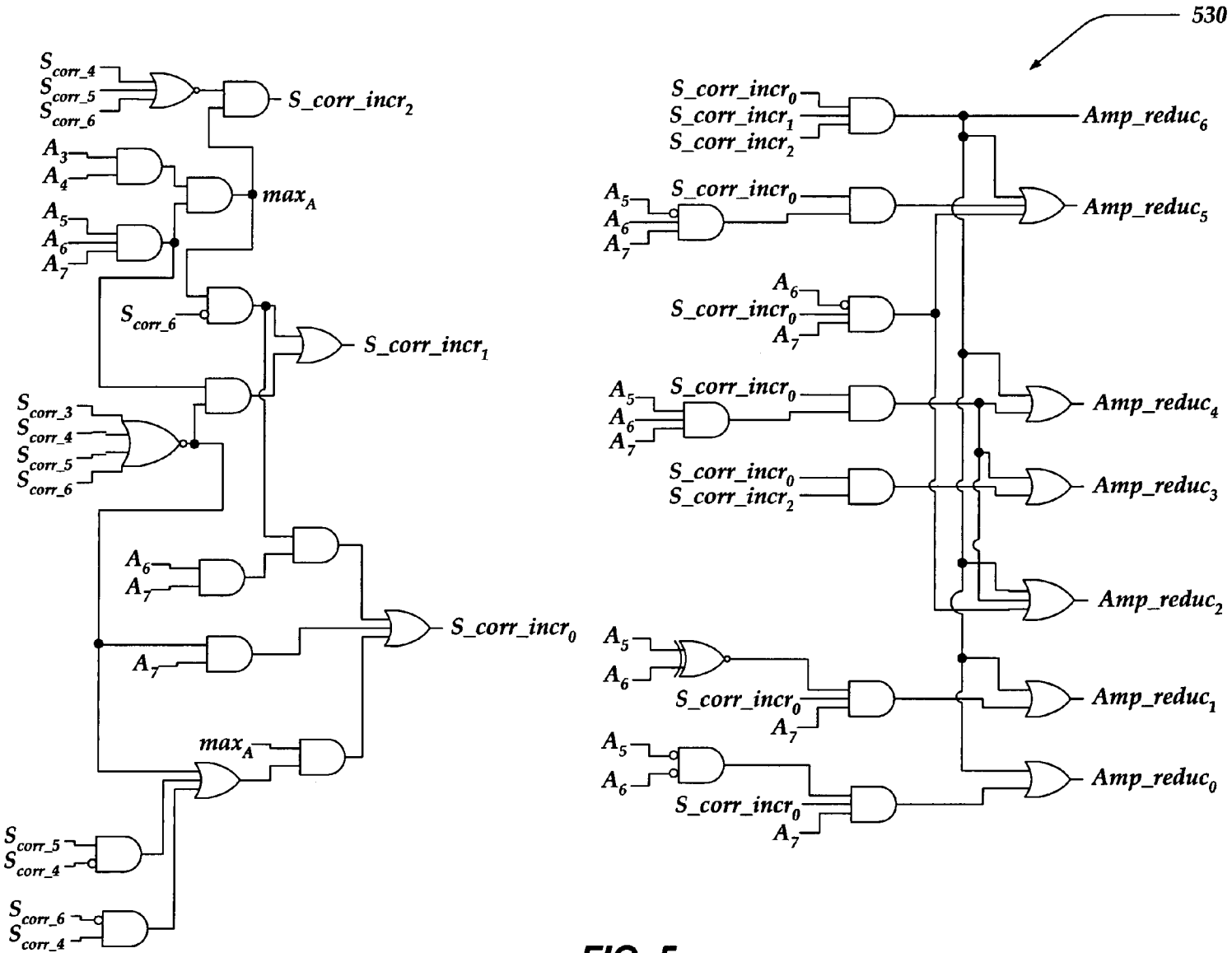
FIG. 5 schematically illustrates one embodiment of a constant current decoder of the vertical S linearity correction circuit of FIG. 4.

Both S_corr_incr and Amp_reduc may comprise a plurality of signals and constant current decoder 430 may determine S_corr_incr and Amp_reduc employing a digital algorithm. For example, constant current decoder 430 may include a plurality of AND, OR, and NOT gates that are arranged to receive individual input signals of $S_{corr}$ and A, and combine the individual input signals, based on a predetermined algorithm, to provide individual control signals of S_corr_incr and Amp_reduc. An example of such a logic circuit embodying constant current decoder 430 is illustrated in FIG. 5.

As described above, S_corr_incr and Amp_reduc may be digital signals in one embodiment controlling a voltage or current source in threshold generator 432 and a plurality of digitally-controlled resistors RA1–RA3 in ramp conditioning circuit 424. In another embodiment, at least one of S_corr_incr and Amp_reduc may include currents that are employed to control a current-controlled current source in threshold generator 432 or current-controlled resistors in ramp conditioning circuit 424.

In one embodiment, threshold generator 432 may include a voltage or current-controlled current source 462 and a resistive ladder comprising at least resistors R1–R3. If current source 462 is a voltage-controlled current source, S_corr_incr may be at least one control voltage provided by constant current decoder 432 based, in part, on $S_{corr}$ and A. Alternatively, if current source 462 is a current-controlled current source, S_corr_incr may be at least one control current provided by constant current decoder 432 based, in part, on $S_{corr}$ and A.

A resistance of R1–R3 may be preselected to determine a relationship between $V_{lo}$, $V_{hi}$, and $V_{th}$, such as a ratio, a difference, and the like. A current provided by current source 462 may provide a fine adjustment of the values of $V_{lo}$, $V_{hi}$, and $V_{th}$.

In one embodiment, ramp generator 434 may include voltage-controlled voltage source 464, which is arranged to generate sawtooth-shaped sweep voltage $V_{osc}$ based on $V_{lo}$, $V_{hi}$, and $V_{th}$. As described previously, $V_{lo}$ and $V_{hi}$ determine a lower and an upper limit for sweep voltage $V_{osc}$, while $V_{th}$ may be employed to determined a DC component of $V_{osc}$ for use in other correction circuitry. Because $V_{lo}$, $V_{hi}$, and $V_{th}$ are determined based, in part, on $S_{corr}$ and A, an amplitude of $V_{osc}$ is determined also based on $S_{corr}$ and A.

Ramp conditioning circuit 424 may include a digitally-controlled attenuator comprising digitally-controlled resistors RA1–RA3 and inverter 425. In another embodiment, the digitally-controlled attenuator may comprise digitally-controlled transistors that are arranged to operate as resistive components in their linear operating region. A resistance of the digitally-controlled resistors may be determined based on Amp_reduc from constant current decoder 430. By determining the resistance of individual resistors RA1–RA3 based on Amp_reduc, amplitude-corrected sweep voltage $a*V_{osc}$ may be provided to correction circuit 428, while an $S_{corr}$-independent sweep voltage $V_{rp}$ (and $V_{rn}$) may be provided to waveform generator 436.

In another embodiment, the digitally-controlled attenuator 424 may be arranged to provide an inverted version of $V_{rp}$, $V_{rn}$ to waveform generation circuit 426 as well. Inverter 425, which is coupled to RA3, may be employed for inverting the voltage, and $V_{rn}$ may be used to generate appropriate second and fourth order voltages for other circuits such as a C linearity correction circuit or a top-and-bottom corner correction circuit.

Waveform generator circuit 426 is arranged to operate substantially similarly to waveform generation circuit 326 described in FIG. 3.

Correction circuit 428 may include summing amplifier 466 in one embodiment. Summing amplifier 466 may be arranged to receive $a*V_{osc}$ and $b*V_{cube}$, and to provide S linearity corrected output voltage $V_{out}$. Adding $a*V_{osc}$ and $b*V_{cube}$ may provide an appropriate amount of S correction as well as compensation for a reduction of the amplitude of the sweep voltage as discussed previously. Correction circuit 428 may also be arranged to receive $V_{cube}$ from waveform generation circuit 426 and provide the coefficient "b" before adding $a*V_{osc}$ and $b*V_{cube}$.

In another embodiment, correction circuit 428 may comprise multiple stages including a comparator, a summing amplifier, and the like, and combine $a*V_{osc}$ and $b*V_{cube}$ based, in part, on a comparison with $V_{ref}$. The comparison with $V_{ref}$ may provide an additional point of control in determining corrected output voltage $V_{out}$.

FIG. 5 schematically illustrates one embodiment of constant current decoder 530 of the vertical S linearity correction circuit of FIG. 4. Constant current decoder 530 comprises a plurality of logic gates such as AND, OR, NOR, and XNOR gates. Various logic gates of constant current decoder 530 are arranged to receive individual input signals $S_{corr3}$–$S_{corr6}$ and $A_0$–$A_7$, and to provide individual signals $S_corr_incr_0$–$S_corr\ incr_2$ and $Amp_reduc_0$–$Amp_reduc_6$.

In one embodiment, the logic gates comprising constant current decoder 530 may be arranged according to a predetermined digital algorithm. In another embodiment, additional or fewer logic gates may be employed to implement a different digital algorithm without departing from the spirit and scope of the invention.

Figure 6:
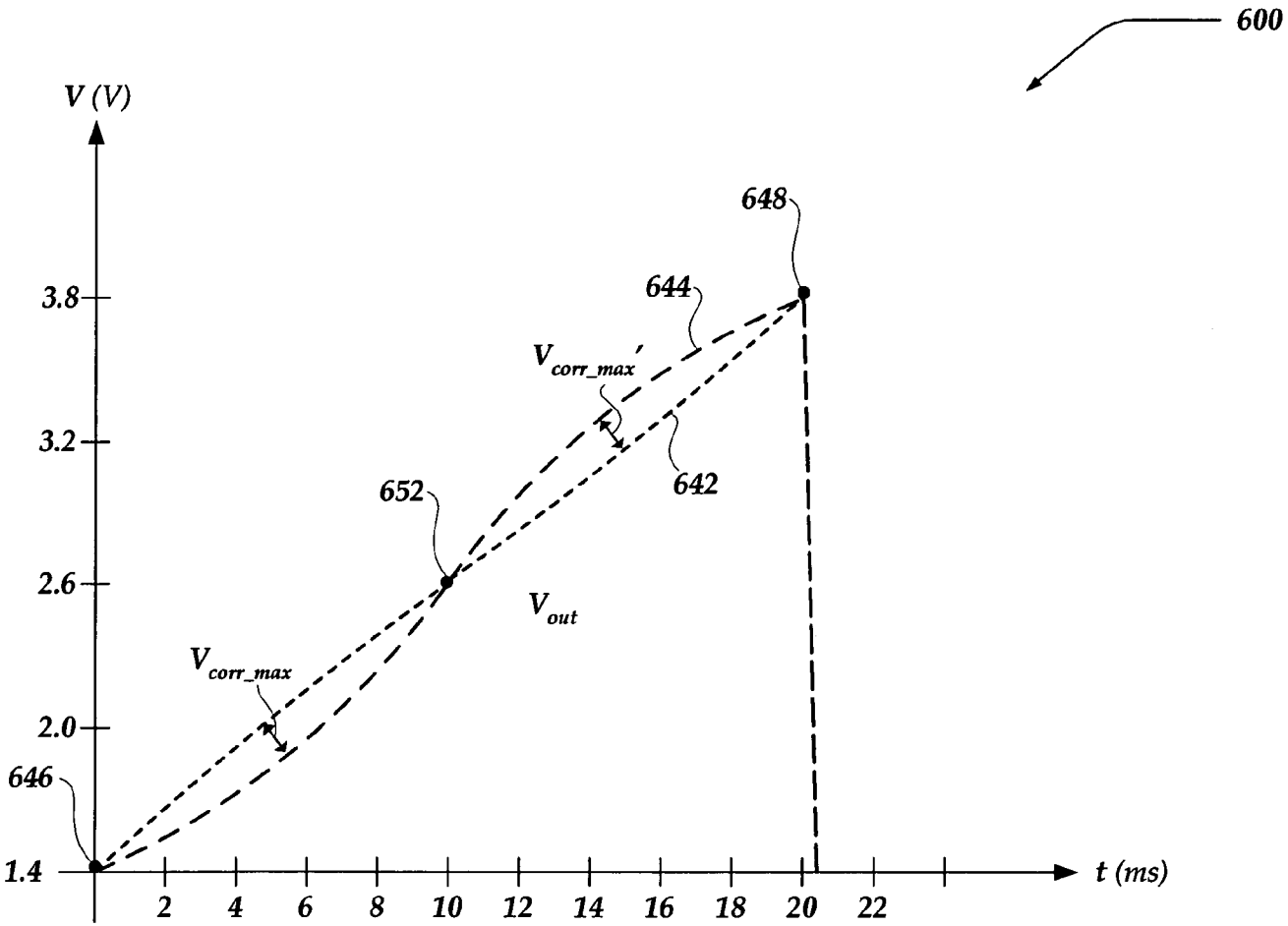
FIG. 6 illustrates waveforms of an embodiment of an output voltage of the vertical S linearity correction circuit of FIG. 3 according to aspects of the present invention.

FIG. 6 illustrates voltage diagram 600 showing waveforms of an embodiment of an output voltage of the vertical S linearity correction circuit of FIG. 3.

A vertical axis of voltage diagram 600 represents voltage V in volts. A horizontal axis represents time t in milliseconds (ms). While volts and milliseconds are represented on voltage diagram 600, the invention is not so limited. Virtually any voltage and time units may be employed in implementing the present invention without departing from spirit and scope of the invention. Voltage diagram 600 illustrates waveform 642 representing uncorrected output voltage with a sawtooth-like shape. When this voltage is applied as sweep voltage to an electron beam, line spacing at the top and bottom of the screen may become unequal due to a shape of the CRT tube and an angle at which the electron beam reaches the top and bottom edges of the screen compared to a middle of the screen.

When a third order correction voltage $V_{cube}$ is applied to the sweep voltage, its shape changes to that of waveform 644. The deviation of a slope of waveform 644 from a linearly increasing slope enables a correction of the line spacing at the top and bottom edge of the screen. An amount of the deviation, $V_{corr_max}$ and $V_{corr_max}'$ depends on an amount of S correction provided to the vertical S linearity correction circuit such as $S_{corr}$ in FIGS. 2 and 3.

When the cubed voltage $V_{cube}$ is applied to the sweep voltage, however, an amplitude of the output voltage $V_{out}$ may be reduced bringing start point 646 up and end point 648 down based on an amount of S correction. As described previously, providing a second voltage component with a different correction factor may compensate for the amplitude reduction resulting in start point 646 and end point 648 remaining in their original positions. This prevents a reduction of a size of the displayed picture on the screen. The waveforms represent one cycle of a sawtooth-shaped sweeping voltage. The same waveform is typically repeated when the circuit is operational.

In one embodiment, correction voltage $V_{cube}$ may be derived from sweep voltage $V_{osc}$ at a center of the voltage, as shown by point 652 in the figure.

While the specification refers to a third order S linearity correction, higher order voltages such as fifth, seventh, ninth, and the like may be employed to provide correction for enabling equal line spacing at a top and bottom of a screen as well. Accordingly, the circuits described above may be modified to employ higher order correction voltages, wherein the correction voltage is of an odd integer order without departing from the scope and spirit of the invention.

The above specification, examples and data provide a description of the manufacture and use of the composition of the invention. Since many embodiments of the invention can be made without departing from the spirit and scope of the invention, the invention also resides in the claims hereinafter appended.

We claim:

1. A device for performing S linearity correction, comprising:

a ramp generation and amplitude control circuit that is arranged to receive a plurality of digital signals, and to provide a sawtooth-shaped sweep voltage and an amplitude correction signal in response to the plurality of digital signals;

a ramp conditioning circuit that is arranged to provide an amplitude modulated sweep voltage and an unmodulated sweep voltage in response to the sawtooth-shaped sweep voltage and the amplitude correction signal;

a waveform generation circuit that is arranged to provide a third order voltage based, in part, on the unmodulated sweep voltage; and a correction circuit that is arranged to provide a corrected output voltage based, in part, on the amplitude modulated sweep voltage and the third order voltage, such that a line spacing between horizontal lines toward a top and a bottom of a screen is substantially equal to another line spacing in a middle of the screen, and such that a size of a displayed picture is substantially maintained before and after an application of S linearity correction.

2. The device of claim 1, wherein the plurality of digital signals comprises:

a first digital signal that indicates an amplitude for the sweep voltage; and a second digital signal that indicates an amount of S linearity correction.

3. The device of claim 1, wherein the correction circuit comprises at least one summing amplifier that is arranged to provide the corrected output voltage based on a combination of the third order voltage and the amplitude modulated sweep signal.

4. The device of claim 1, wherein the corrected output voltage is arranged to control a vertical deviation of an electron beam during its horizontal sweep in a Cathode Ray Tube (CRT) such that line spacing between horizontal lines toward the top and bottom edges of the screen is substantially equal to line spacing in the middle of the screen.

5. The device of claim 1, wherein the ramp generation and amplitude control circuit comprises:

a constant current decoder that is arranged to provide a first correction signal that includes S linearity correction information and a second correction signal that includes amplitude correction information in response to the plurality of digital signals;

a threshold generator that is arranged to provide a high limit voltage, a low limit voltage, and a threshold voltage in response to the first correction signal such that an upper and a lower limit of a sweep voltage are determined; and a ramp generator that is arranged to provide the sweep voltage in response to the high limit voltage, the low limit voltage, and the threshold voltage such that an amplitude of the sweep voltage is determined based, in part, on the S linearity correction.

6. The device of claim 5, wherein the threshold generator comprises a resistor ladder and at least one of a current-controlled current source and a voltage-controlled current source.

7. The device of claim 5, wherein the ramp generator comprises at least one of a voltage-controlled voltage source and a current-controlled voltage source.

8. The device of claim 1, wherein the ramp conditioning circuit comprises a digitally-controlled attenuator circuit that is arranged to provide:

the unmodulated sweep voltage to the waveform generation circuit; and the modulated sweep voltage to the correction circuit.

9. The device of claim 8, wherein a resistance of each resistor in the digitally-controlled attenuator is determined based, in part, on a second correction signal provided by the ramp generation and amplitude control circuit.

10. The device of claim 8, wherein the ramp conditioning circuit is further arranged to provide an unmodulated inverted sweep voltage to the waveform generation circuit.

11. The device of claim 8, wherein the waveform generation circuit includes a waveform generator that is arranged to provide a second order voltage, a third order voltage, and a fourth order voltage in response to the unmodulated sweep voltage, the inverted unmodulated sweep voltage, and the reference voltage.

12. The device of claim 11, wherein:

the second order voltage is provided to a vertical C linearity correction circuit; and the fourth order voltage is provide to a top-and-bottom corner correction circuit.

13. The device of claim 11, wherein the waveform generation circuit further includes an operational amplifier that is arranged to operate as a follower to provide the third order voltage to the correction circuit.

14. The device of claim 11, wherein the waveform generation circuit is further arranged to provide at least one of a fifth order voltage, a seventh order voltage, and a ninth order voltage; and wherein the correction circuit is further arranged to provide the corrected output voltage based, in part, on one of the fifth order voltage, the seventh order voltage, and the ninth order voltage.

15. A device for performing nth order linearity correction, comprising:

a first circuit that is arranged to generate a sawtooth-shaped ramping signal;

a second circuit that is arranged to modulate an amplitude of the ramping signal based on a received amount of nth order linearity correction;

a third circuit that is arranged to generate an nth order voltage based on the ramping voltage, wherein n=2k+1 and k is a positive integer; and a fourth circuit that is arranged to combine the amplitude modulated ramping voltage and the nth order voltage, and to provide a corrected output voltage such that a line spacing between horizontal lines toward a top and a bottom of a screen is substantially equal to another line spacing in a middle of the screen, and a size of a displayed picture is substantially maintained after the nth order linearity correction.

* * * * *

UNITED STATES PATENT AND TRADEMARK OFFICE

CERTIFICATE OF CORRECTION

PATENT NO. : 6,998,798 B1
APPLICATION NO. : 10/915135
DATED : February 14, 2006
INVENTOR(S) : Charles Guan et al.

It is certified that error appears in the above-identified patent and that said Letters Patent is hereby corrected as shown below:

In the Specification:

Column 4, Line 33, After "$V_{rp}$" and insert - - , - -.

Column 4, Line 39, After "$V_{OSC}$" insert - - , - -.

Column 4, Line 50, Delete "VP," and insert - - $V_{rp}$, - -.

Column 6, Line 55, Delete "Of" and insert - - of - -.

Column 8, Line 31, Delete "S_corr $incr_2$" and insert - - S_corr_$incr_2$ - -.

Signed and Sealed this

Fifteenth Day of August, 2006

JON W. DUDAS
*Director of the United States Patent and Trademark Office*